US008839952B2

(12) United States Patent
Kim

(10) Patent No.: US 8,839,952 B2
(45) Date of Patent: Sep. 23, 2014

(54) PACKAGE FOR INSTRUMENT STRING

(71) Applicant: Hak Yeoul Kim, Siheung-si (KR)

(72) Inventor: Hak Yeoul Kim, Siheung-si (KR)

( * ) Notice: Subject to any disclaimer, the term of this patent is extended or adjusted under 35 U.S.C. 154(b) by 0 days.

(21) Appl. No.: 13/623,160

(22) Filed: Sep. 20, 2012

(65) Prior Publication Data

US 2013/0193013 A1 Aug. 1, 2013

(30) Foreign Application Priority Data

Jan. 27, 2012 (KR) ..... 20-2012-0000626

(51) Int. Cl.
*A45C 11/00* (2006.01)
*B65D 73/00* (2006.01)

(52) U.S. Cl.
USPC ..... 206/314; 206/482; 206/408

(58) Field of Classification Search
USPC ..... 206/314, 63.3, 476, 364, 571, 465, 490, 206/464, 482, 487, 467, 295, 481, 408; 229/149, 126, 131.1, 141, 142
See application file for complete search history.

(56) References Cited

U.S. PATENT DOCUMENTS

| | | | | | |
|---|---|---|---|---|---|
| 197,585 | A | * | 11/1877 | Ashman | 206/314 |
| 718,114 | A | * | 1/1903 | Finney | 206/314 |
| 2,008,026 | A | * | 7/1935 | MacMurray | 206/408 |
| 3,352,416 | A | * | 11/1967 | Lo Duca | 206/314 |
| 4,583,315 | A | * | 4/1986 | Schreck | 43/54.1 |
| 5,109,983 | A | * | 5/1992 | Malone et al. | 206/408 |
| 5,438,791 | A | * | 8/1995 | Sherrod | 43/57.2 |
| 5,819,918 | A | * | 10/1998 | Scanlon | 206/63.3 |
| 5,957,282 | A | * | 9/1999 | Juszkiewicz et al. | 206/314 |

FOREIGN PATENT DOCUMENTS

KR 200255742 11/2001

* cited by examiner

*Primary Examiner* — Anthony Stashick
*Assistant Examiner* — Mollie Llewellyn
(74) *Attorney, Agent, or Firm* — Cantor Colburn LLP

(57) ABSTRACT

A package for an instrument string includes a base plate, and a fastening unit which includes at least two fasteners provided on the base plate to receive the instrument string where the instrument string that is in a wound state is inserted between the base plate and the at least two fasteners and fastened to the base plate before the instrument string is packed into a packing bag to make a work of packing the instrument easy.

1 Claim, 8 Drawing Sheets

PACKAGE FOR INSTRUMENT STRING

BACKGROUND OF THE INVENTION

1. Field of the Invention

The present invention relates generally to packages for instrument strings which facilitate packing instrument strings and, more particularly, to a package for an instrument string which is provided to solve a problem of a conventional packing method which includes winding an instrument string while twisting the wound portions, and inserting an end of the instrument string between the twisted portions, and in which the instrument string can be easily fastened to the package merely by inserting the string between the base plate and fasteners provided on the base plate before it is packed by a packing bag, thus making it easy to pack the instrument string.

2. Description of the Related Art

Among musical instruments, an instrument which uses a string(s) as a sounding body to generate sounds is called a string instrument. Depending on how the instrument is played, string instruments are classified into a plucked string instrument which is played by plucking the strings with the nails of a player or a pick, a rubbed string instrument which is played by rubbing the strings with a bow, and a struck string instrument which is played by striking the strings with a stick.

A guitar is a representative example of a popular plucked string instrument. A violin, a cello, etc. are examples of popular rubbed string instruments.

In string instruments such as a guitar, a violin, or a cello, the strings are very important for producing a good sound. If there is a problem with the strings, for example, if a string snaps, a user must replace it with a new one. For this, the user typically carries extra instrument strings.

Generally, for extra instrument strings that have to be always carried, an instrument string is packed, as shown in FIG. 1. The instrument string S is wound in a circle. While winding the instrument string S, it must be twisted so that it can be easily inserted into a packing bag B later, and after packing, the packing bag B can be prevented from being torn.

That is, in the case where the instrument string S is directly inserted into the packing bag after it is only wound in a circle, an end Sa of the instrument string S springs out. This makes it difficult to insert the instrument string S into the packing bag. Even though the instrument string S can be inserted into the packing bag, a problem may occur, for example, the pointed end Sa may tear the packing bag (refer to FIG. 1A). To avoid this problem, when the instrument string S is being wound, not only must it be twisted but the end Sa thereof must also be inserted between the twisted portions to prevent it from unexpectedly springing out. Thereafter, the twisted instrument string S must be packed using the packing bag (refer to FIG. 1B).

However, if the instrument string that has been wound in a circle and twisted is stored for a long period of time without being used, the instrument string may be permanently deformed. In this case, after the instrument string is installed on an instrument, the permanent deformation of the string may make it impossible for the string to produce a normal sound.

In other words, even after the instrument string that has been packed is unpacked, the instrument string itself is in a twisted or torsional state (refer to FIG. 1C). Thus, the instrument string cannot ensure normal sound quality.

Furthermore, to prevent the end of the instrument string from springing out, a separate tying string is sometimes used to tie the end of the instrument string to a portion of the instrument string. However, in any way, the number of processes of packing the instrument string is comparatively large, making the packing work difficult.

In the case of a violin, it includes four strings. In the conventional packing method, four kinds of strings each of which is packed by the above-mentioned method (that is, by four packing bags) are generally sold by the bundle (of course, each of the four kinds of strings may be individually sold).

SUMMARY OF THE INVENTION

Accordingly, the present invention has been made keeping in mind the above problems occurring in the prior art, and a first object of the present invention is to provide a package which makes it possible to simply pack an instrument string without carrying out the processes of twisting the instrument string and inserting an end of the string between the twisted portions which have been required to prevent the end of the string from springing out when packing the instrument string in the conventional art.

A second object of the present invention is to provide a package which has a simple structure and is yet able to achieve the first object.

A third object of the present invention is to provide a package which can minimize deformation of the instrument string, in other words, can maintain the straightness of the instrument string after it has been unpacked.

A fourth object of the present invention is to provide a package which is configured such that several instrument strings which are used in a single instrument can be packed in a single package and sold.

In order to accomplish the above objects, the present invention provides a package for an instrument string, including a base plate, and a fastening unit comprising at least two fasteners provided on the base plate to receive the instrument string, wherein the instrument string that is in a wound state is inserted between the base plate and the fasteners and fastened to the base plate.

Each of the fasteners may be formed by cutting a portion of the base plate and include a connection portion connected to the base plate, and a cutting portion formed to be separated from the base plate.

In this case, a space may be defined between the cutting portion and a cut edge of the base plate that faces the cutting portion.

Alternatively, each of the fasteners may be formed by attaching one surface thereof to the base plate.

Furthermore, insert slots may be formed in the base plate, wherein after the instrument string is inserted between the base plate and the fasteners, an end of each of the fasteners is inserted into the corresponding insert slot.

The fastening unit may comprise at least two fastening units provided on the base plate to receive at least two instrument strings.

BRIEF DESCRIPTION OF THE DRAWINGS

The above and other objects, features and advantages of the present invention will be more clearly understood from the following detailed description taken in conjunction with the accompanying drawings, in which.

DESCRIPTION OF THE PREFERRED EMBODIMENTS

Hereinafter, a package for an instrument string according to the present invention will be described in detail with reference to the attached drawings.

Although embodiments of the present invention will be described below on the assumption that an instrument string is for a string instrument, the package of the present invention is not limited to string instruments.

Figure 1A:
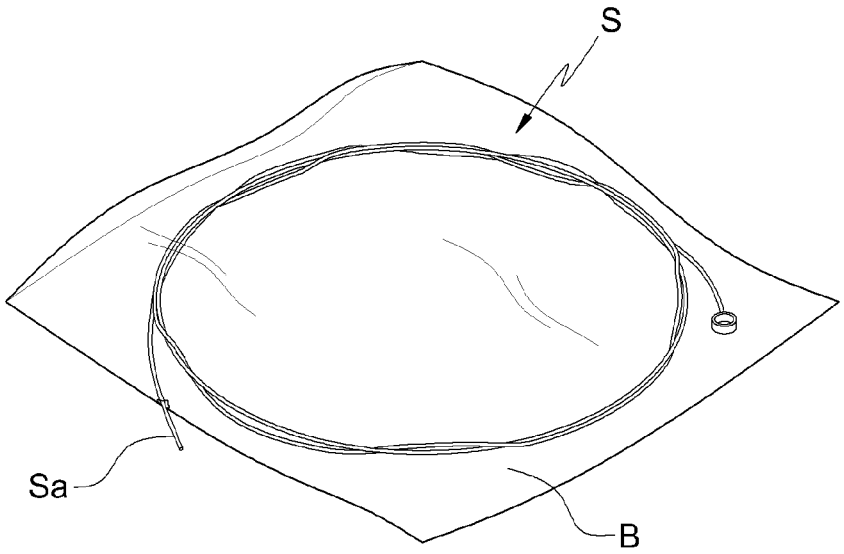
FIG. 1A Prior Art
FIGS. 1A through 1C are views illustrating a conventional method of packing an instrument string and a packed state of the instrument string.
Figure 1B:
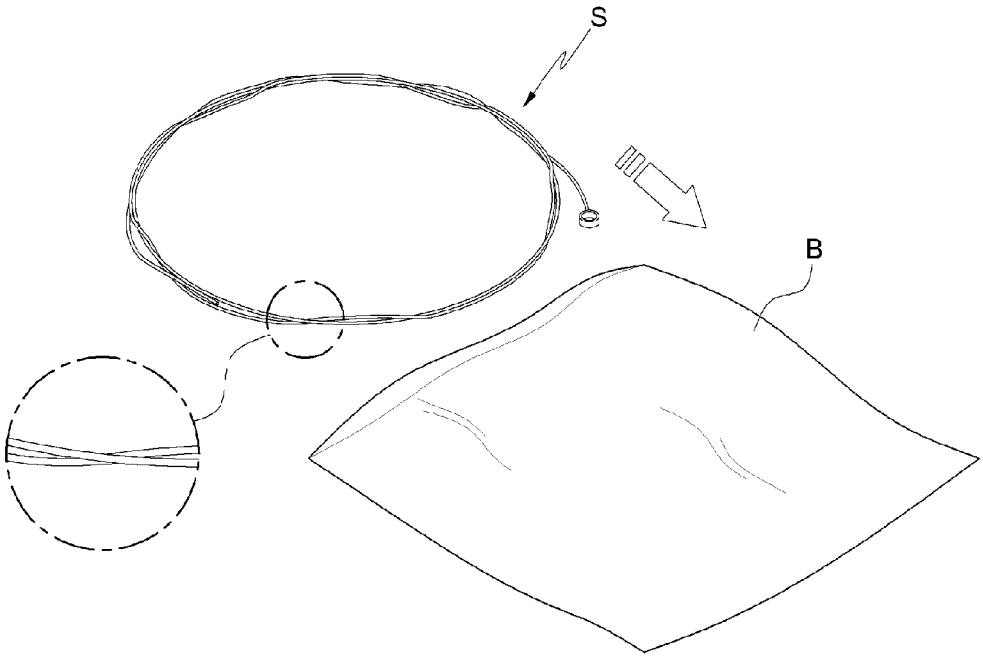
FIG. 1B Prior Art
Figure 1C:
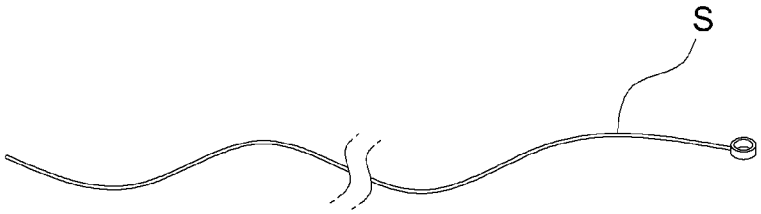
FIG. 1C Prior Art
Figure 2A:
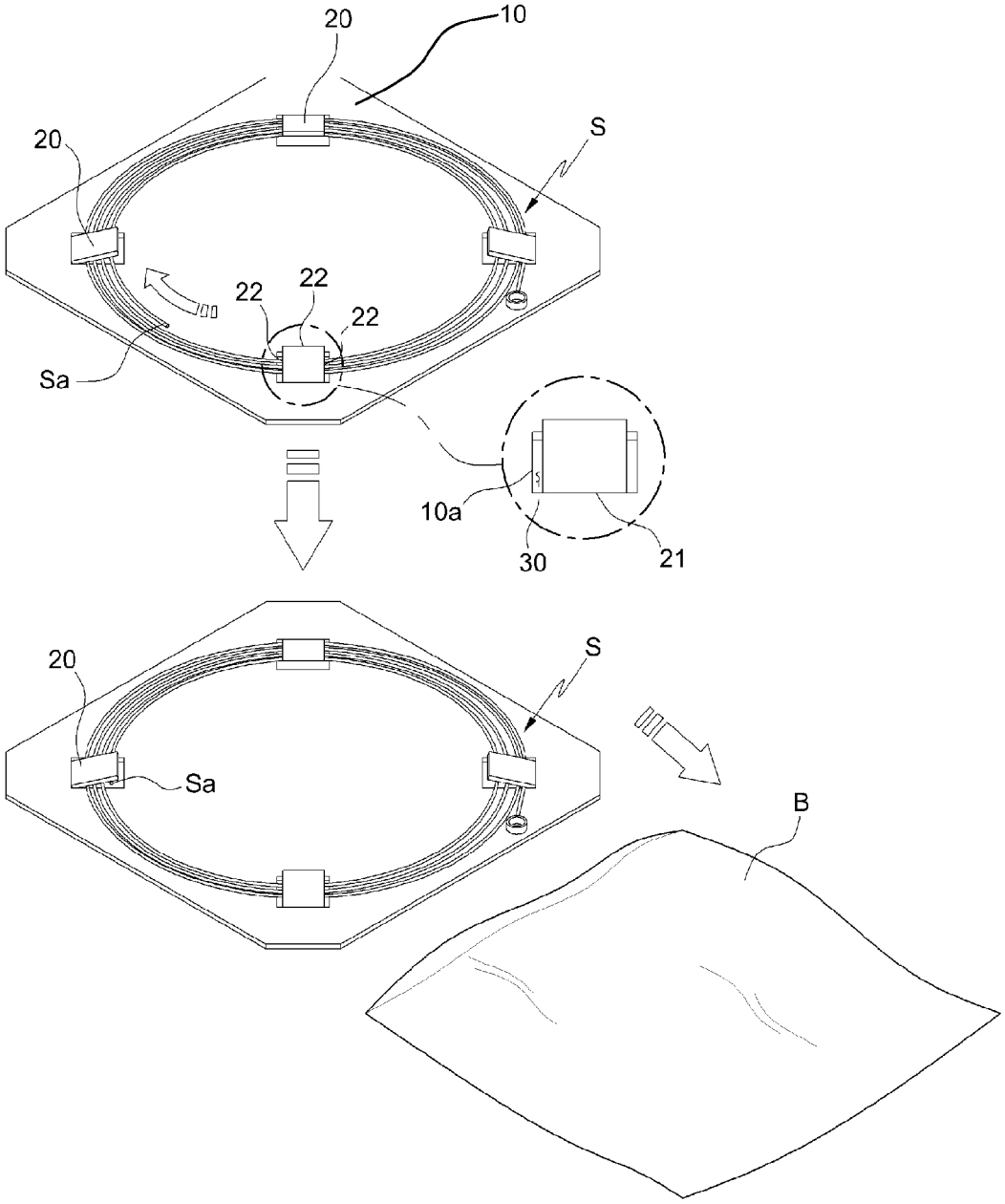
FIGS. 2A and 2B are views illustrating a package for an instrument string, according to an embodiment of the present invention.
Figure 2B:
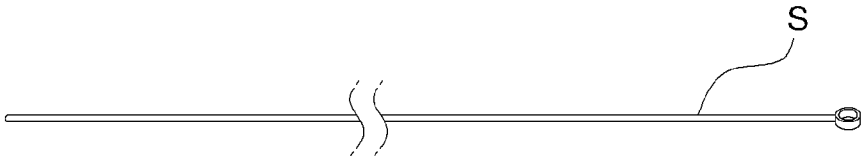
Figure 3:
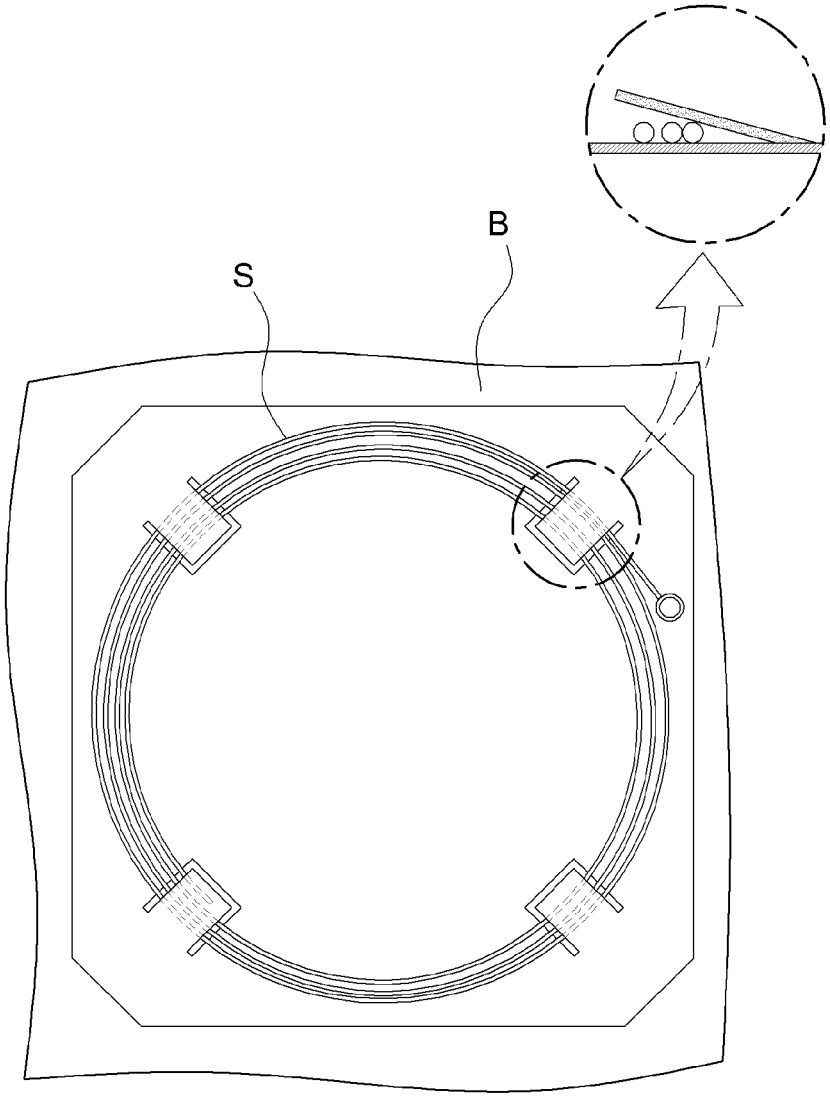
FIG. 3 is a view illustrating the package from another angle.

As shown in FIGS. 2 and 3, a package P for an instrument string according to the present invention includes a base plate 10 and a fastening unit which includes a set of fasteners 20 that are provided on the base plate 10 to receive the instrument string.

That is, the fastening unit includes multiple fasteners 20 which form a single unit. In the package of the present invention, preferably, two or more fasteners 20 are provided on the base plate 10, and the instrument string can be received on the base plate 10 by the fasteners 20.

In this embodiment shown in these drawings, the package is configured such that four fasteners receive a single instrument string.

In the package P of the present invention having the above-mentioned construction, a user releases the fasteners 20 from the base plate 10 and inserts the instrument string S, which has been in the wound state, between the base plate 10 and the fasteners 20. In this way, the instrument string S can be easily fastened to the package P. Subsequently, the package P to which the instrument string S has been fastened is inserted into a packing bag B, thus completing packing the instrument string S.

Unlike the conventional packing method in which the instrument string is twisted before it is packed in a packing bag, in the case of the present invention, because the instrument string is merely wound rather than being twisted, an end Sa of the instrument string may stick out of the package depending on the position at which the end Sa of the instrument string is located.

In this case, the user can easily solve this problem in such a way that the user merely rotates the instrument string that has been fastened to the package P such that the end Sa of the instrument string is disposed inside one of the fasteners 20 (refer to FIG. 2A).

The fasteners 20 may be provided on the base plate 10 in such a way that one end of each fastener 20 is bonded to the base plate after the fasteners 20 are produced separately from the base plate 10. Alternatively, as shown in FIGS. 2 and 3, the fasteners 20 may be integrally provided on the base plate 10 by cutting portions of the base plate.

In other words, the fasteners 20 illustrated in FIGS. 2 and 3 are formed by cutting corresponding portions of the base plate 10.

In detail, as shown in the drawings, if the shape of each fastener 20 is a rectangular shape, it can be formed by cutting three sides of a corresponding portion of the base plate with the exception of an outer side (that faces the outer edge of the base plate) of the corresponding portion.

For instance, if each fastener 20 has a triangular shape, it can be formed by cutting two sides of a corresponding portion of the base plate with the exception of the outermost side of the corresponding portion.

As such, for the purpose of facilitating a manufacturing process and in order to enhance the durability of the product, it is preferable that the fasteners 20 be integrally provided in the base plate 10 by cutting the corresponding portions of the base plate 10. Nevertheless, forming the fasteners through a separate bonding process does not depart from the scope and spirit of the invention.

Each fastener includes a connection portion 21 which is connected to the base plate 10, and cutting portions 22 which are formed to be separated from the base plate 10.

In the case where each fastener is formed by cutting a portion of the base plate 10 and the cutting portions 22 are thus formed on the fastener, it is preferable that a space 30 be defined between each cutting portion 22 and a cut edge of the base plate that faces the cutting portion 22.

The reason for this is not only because turning up the fastener to insert the instrument string into the fastener can be facilitated but also because friction between the cutting portion of the fastener and the cut edges of the base plate can be minimized even though the fastener is repetitively turned up and down, so that the durability of the product can be enhanced.

Furthermore, the package of the present invention may be configured such that an end of each fastener is inserted into the base plate so that the instrument string can be more reliably fastened to the base plate.

Figure 4:
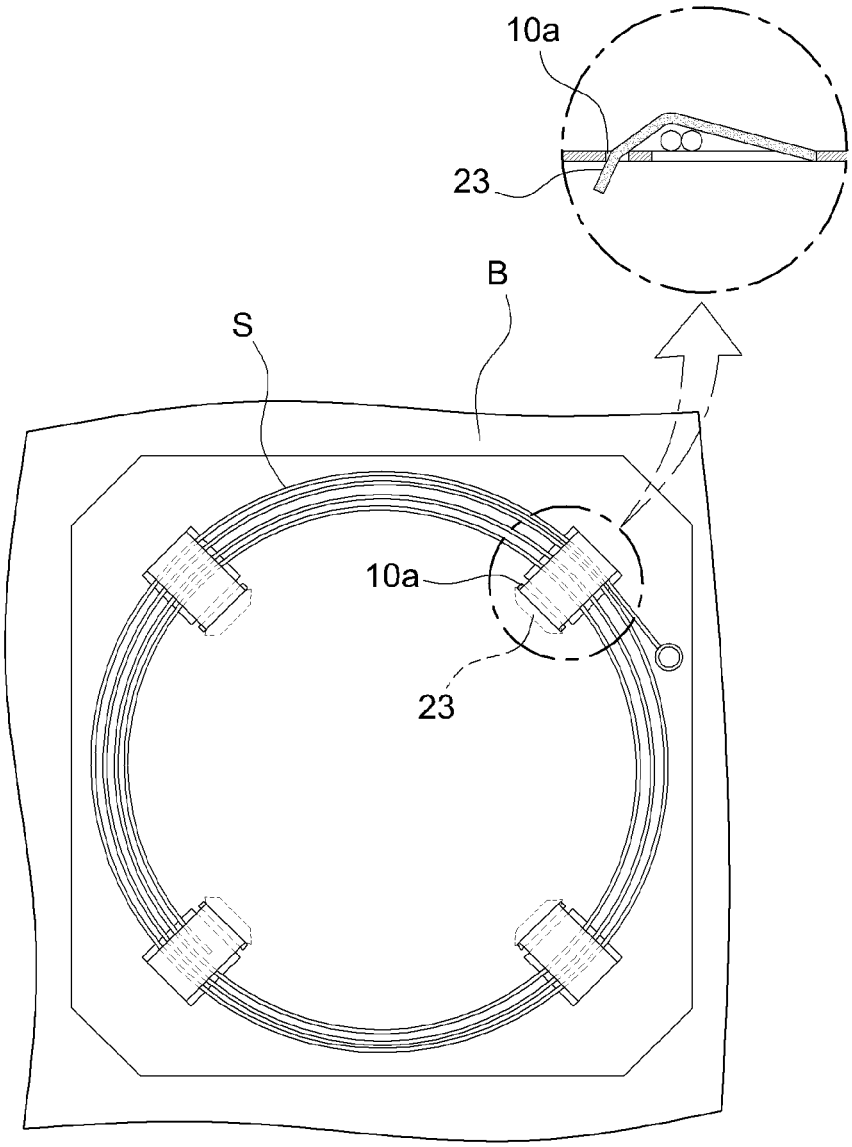
FIG. 4 is a view illustrating a package for an instrument string, according to another embodiment of the present invention.

In detail, as shown in FIG. 4, in this embodiment, insert slots 10*a* are formed in the base plate 10. Thus, after the instrument string S is disposed between the base plate 10 and the fasteners 20, an insert end 23 of each fastener 20 is inserted into the corresponding insert slot 10*a* so that the instrument string S can be more reliably fastened to the base plate 10.

Here, if the fasteners 20 are produced separately from the base plate 10 and then bonded thereto, each fastener 20 has only to be designed to have a length appropriate to put the insert end 23 of the fastener into the insert slot 10*a*.

If the fasteners 20 are formed by cutting portions of the base plate 10, a separate insert end 23 has only to be provided on the end of the fastener 20 so that the fastener 20 can be inserted into the insert slot 10*a* by the separate insert end 23.

Preferably, the insert end 23 of the fastener 20 has an increased width so that it cannot be easily removed from the insert slot 10*a* once it has been inserted into the insert slot 10*a*.

After the instrument string S is fastened to the package P, it is inserted into the packing bag before being sold on the market.

Typically, instrument strings may be sold individually. Alternatively, all of instrument strings that are used in a single musical instrument may be sold in a bundle.

For instance, in the case of a violin, it includes four instrument strings (a first string, a second string, a third string and a fourth string). Although each string may be separately sold, four kinds of strings are generally sold by the bundle. Further, from a consumer's viewpoint, if they buy instrument strings by the bundle, they can purchase the strings at a lower price. Given this, consumers generally purchase instrument strings by the bundle.

Here, when the instrument strings are sold by the bundle, if four package bags each of which contains an instrument string are sold in a bundle, the volume of the entirety of the instrument strings increases. From a consumer's viewpoint, there is a disadvantage in that an increase in the volume of products makes it difficult to store them.

To avoid the above problems, the package of the present invention may be configured such that a plurality of instrument strings are fastened to a single package. In this case, bundling can be facilitated.

Figure 5:
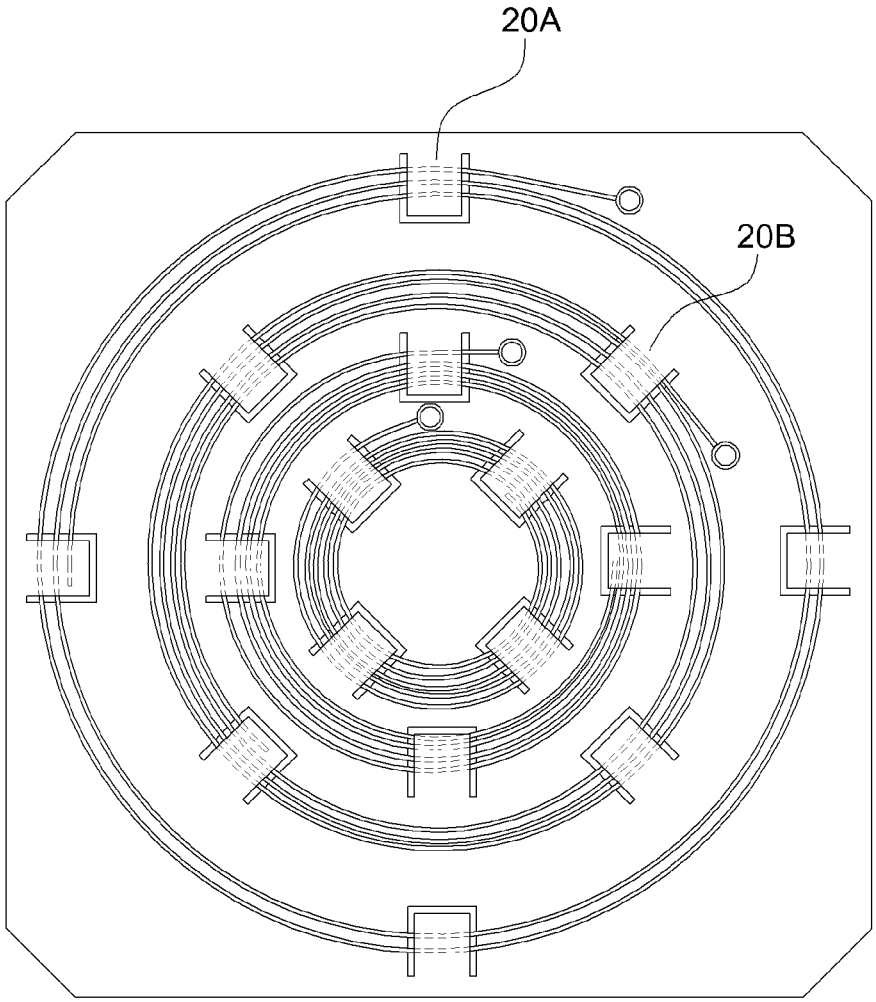
FIG. 5 is a view illustrating a package for an instrument string, according to a further embodiment of the present invention.

In detail, as shown in FIG. 5, in the package of the present invention, two or more fastening units may be provided on a single base plate 10 to receive a plurality of instrument strings.

In FIG. 5, although the package is illustrated as having four fastening units, the number of fastening units can be increased or reduced when necessary.

The fastening units are preferably arranged along imaginary concentric circles on the base plate.

In this arrangement, it is preferable that the fasteners between adjacent fastening units be alternately arranged.

That is, as shown in FIG. 5, for the sake of space efficiency, fasteners of a first fastening unit 20A that is disposed at the outermost position of the base plate preferably alternate with fasteners of a second fastening unit 20B that is disposed inside and adjacent to the first fastening unit 20A, rather than being aligned with the fasteners of the second fastening unit 20B.

As described above, in a package for an instrument string according to the present invention, the instrument string can be fastened to the base plate in such a way that the instrument string that has been wound is inserted between a base plate and fasteners. Therefore, unlike the conventional instrument string packing method, an additional process of twisting the instrument string or inserting an end of the instrument string between twisted portions of the string is not required. Therefore, the present invention can facilitate the work of packing the instrument string.

Furthermore, because the fasteners can be formed using portions of the base plate, the structure of the package can be simplified.

Moreover, the present invention does not need to twist the instrument string when packing it. This can prevent the instrument string from being deformed. Thus, the instrument string can remain in its original state, thus maintaining the quality given when produced. In other words, the straightness of the instrument string is superior.

In addition, a plurality of fastening units may be provided on a single base plate. In this case, all of the instrument strings which are used in a musical instrument can be packed in a single package, thus reducing its volume, and making its transportation and storage more efficient.

Although a package for an instrument string that has a specific shape and structure has been illustrated with reference to the attached drawings for illustrative purposes, those skilled in the art will appreciate that various modifications, additions and substitutions are possible, without departing from the scope and spirit of the invention as disclosed in the accompanying claims.

What is claimed is:

1. A package for an instrument string, comprising:

a base plate; and at least two fastening units each arranged along an imaginary circle and each comprising at least two fasteners provided on the base plate to receive the instrument string, wherein the instrument string is in a wound state and is inserted between the base plate and the at least two fasteners and fastened to the base plate, wherein each of the at least two fastener comprises:

a rectangular through-hole formed in the base plate;

a rectangular plate, an edge of which is bonded to an edge of the rectangular through-hole and a free end of which is directed toward radially inside the imaginary circle; and an insert slot formed separately from and radially inside the rectangular through-hole so that the free end of the rectangular plate can be inserted into the insert slot, wherein the rectangular plate has a width in a circumferential direction of the imaginary circle, the width being narrower than that of the rectangular through-hole; and wherein one of the imaginary circles of one of the fastening units of the at least two fastening units is disposed inside of another of the imaginary circles of another fastening unit of the at least two fastening units.

* * * * *